US006679505B2

(12) United States Patent
Yang

(10) Patent No.: US 6,679,505 B2
(45) Date of Patent: Jan. 20, 2004

(54) STRUCTURE OF SOLE PLATE OF A ROLLER SKATE

(76) Inventor: Lien-Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 58 days.

(21) Appl. No.: 10/060,242

(22) Filed: Feb. 1, 2002

(65) Prior Publication Data

US 2003/0146585 A1 Aug. 7, 2003

(51) Int. Cl.[7] ..... A63C 17/00
(52) U.S. Cl. ..... 280/11.19; 280/11.27
(58) Field of Search ..... 280/11.207, 11.208, 280/11.209, 11.27, 11.28, 11.19

(56) References Cited

U.S. PATENT DOCUMENTS

| | | | | | |
|---|---|---|---|---|---|
| 306,384 | A | * | 10/1884 | Carter | 280/11.28 |
| 324,376 | A | * | 8/1885 | Hart | 280/11.28 |
| 334,896 | A | * | 1/1886 | Robinson | 280/11.19 |
| 901,136 | A | * | 10/1908 | White | 280/11.28 |
| 964,825 | A | * | 7/1910 | Vosseller | 280/11.26 |
| 1,857,360 | A | * | 5/1932 | Coldwell | 280/11.26 |
| 2,073,435 | A | * | 3/1937 | Westerdahl | 280/11.28 |
| 2,079,185 | A | * | 5/1937 | Schmidt | 280/11.28 |
| 2,595,751 | A | * | 5/1952 | Balstad | 280/11.28 |
| 3,901,521 | A | * | 8/1975 | Famolare, Jr. | 280/11.209 |
| 4,109,925 | A | * | 8/1978 | Williams et al. | 280/11.28 |
| 4,262,918 | A | * | 4/1981 | Sandino | 280/11.26 |
| 4,294,455 | A | * | 10/1981 | Krueger | 280/11.209 |
| 4,319,759 | A | * | 3/1982 | Neitz | 280/11.209 |
| 4,334,690 | A | * | 6/1982 | Klamer et al. | 280/11.201 |
| 5,143,388 | A | * | 9/1992 | Chen | 280/11.28 |
| D346,841 | S | * | 5/1994 | Losi, II | D21/763 |
| 5,326,115 | A | * | 7/1994 | Seltzer | 280/11.19 |
| 5,372,383 | A | * | 12/1994 | Kubierschky | 280/842 |
| 5,823,543 | A | * | 10/1998 | Burns et al. | 280/11.225 |
| D464,697 | S | * | 10/2002 | Yang | D21/763 |

* cited by examiner

*Primary Examiner*—Brian L. Johnson
*Assistant Examiner*—Christopher Bottorff
(74) *Attorney, Agent, or Firm*—Dennison, Schultz & Dougherty

(57) ABSTRACT

A sole plate structure of a roller skate, wherein, a sole plate is integrally formed by injection molding of plastic into a flat and elongate shape, and is provided on both the front and the rear ends thereof with two down protruding blocks; and every such two protruding blocks are placed therebetween a vibration absorbing member, two wheel axle covers are provided for the pairs of the front and the rear wheels on the roller skate to have their respective vibration absorbing members and protruding blocks enveloped, and locked with a bolt extending therethrough, the vibration absorbing members can completely absorb the vibrations induced in skating of the roller skate.

5 Claims, 6 Drawing Sheets

STRUCTURE OF SOLE PLATE OF A ROLLER SKATE

BACKGROUND OF THE INVENTION

1. Field of the Invention

The present invention is related to the sole plate structure of a roller skate, and especially to a sole plate with excellent cushion effect, the skate thereby is suitable for application to sports.

2. Description of the Prior Art

Referring to FIG. 1, a conventional roller skate with four rollers has two wheel axle covers "B" (each having thereon two wheels B1) on the front and the rear ends of a sole plate "A" locked with two bolts "D". And a braking block "C" is locked on the front end of the sole plate "A". The two wheel axle covers "B" are provided centrally thereof each with a protruding combining block B2 which has centrally thereof a through hole, the combining block B2 is provided on the rear end thereof with a bevel strut B3 to insert in a front (rear) engaging hole on the sole plate "A". The bolts "D" each is extended through a metallic collar D1, a rubber collar D2, and then is extended through the central through hole of one of the combining blocks B2, and lastly, the metallic collar D1, the rubber collar D2 and a nut D3 are locked in a through hole of the sole plate "A" to complete the sole plate structure of the roller skate.

The above stated roller skate has two rubber collars D2 over the bolts "D" to lock the combining blocks B2, so that when the roller skate is used for a big motion such as jumping, large vibration induced can be absorbed by the rubber collars D2; however, the rubber collars D2 absorb vibration with their planes, they only absorb the vertical vibrations, those smaller vibrations induced such as in turning or circling etc. can not be absorbed by the rubber collars D2. Therefore, such roller skate is not ideal.

In view of the drawbacks of the conventional roller skate, the inventor studied such defects and developed the present invention.

SUMMARY OF THE INVENTION

The primary object of the present invention is to provide the sole plate structure of a roller skate capable of absorbing sideward vibration induced such as in turning or circling etc.

The secondary object of the present invention is to provide the sole plate structure of a roller skate with braking blocks both on the front and the rear ends of the roller skate.

Another object of the present invention is to provide the sole plate structure of a roller skate with reinforced combination of the sole plate with the wheel axle covers.

To achieve the above stated objects, the sole plate of a roller skate of the present invention is integrally formed by injection molding of plastic into a flat and elongate shape, and is provided at the suitable locations on both the front and the rear ends of the sole plate with two down protruding blocks, a vibration absorbing member is placed between the protruding blocks, two wheel axle covers are provided for the pairs of the front and the rear wheels to envelop the vibration absorbing members. In case the strength of the material is not so ideal, a metallic cap is used to cover each wheel axle cover; then the wheel axle covers are firmly locked with bolts. In this mode, the roller skate can completely absorb the vibrations induced in skating by means of the vibration absorbing members.

The present invention will be apparent in its particular structure, principle of application, functions and effects after reading the detailed description of the preferred embodiment thereof in reference to the accompanying drawings.

DETAILED DESCRIPTION OF THE PREFERRED EMBODIMENT

Figure 1:
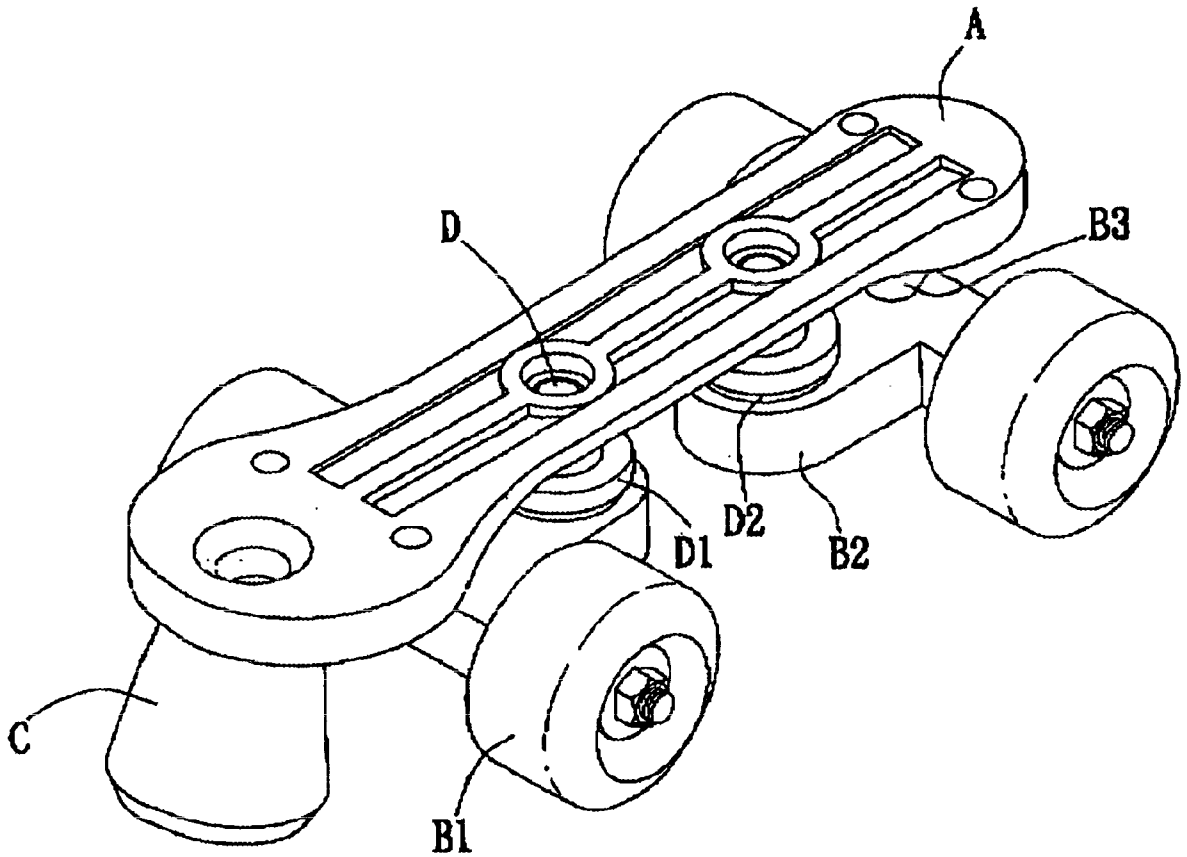
Fig. 1(Prior Art)
FIG. 1 is a perspective view showing the appearance of a conventional roller skate.
Figure 2:
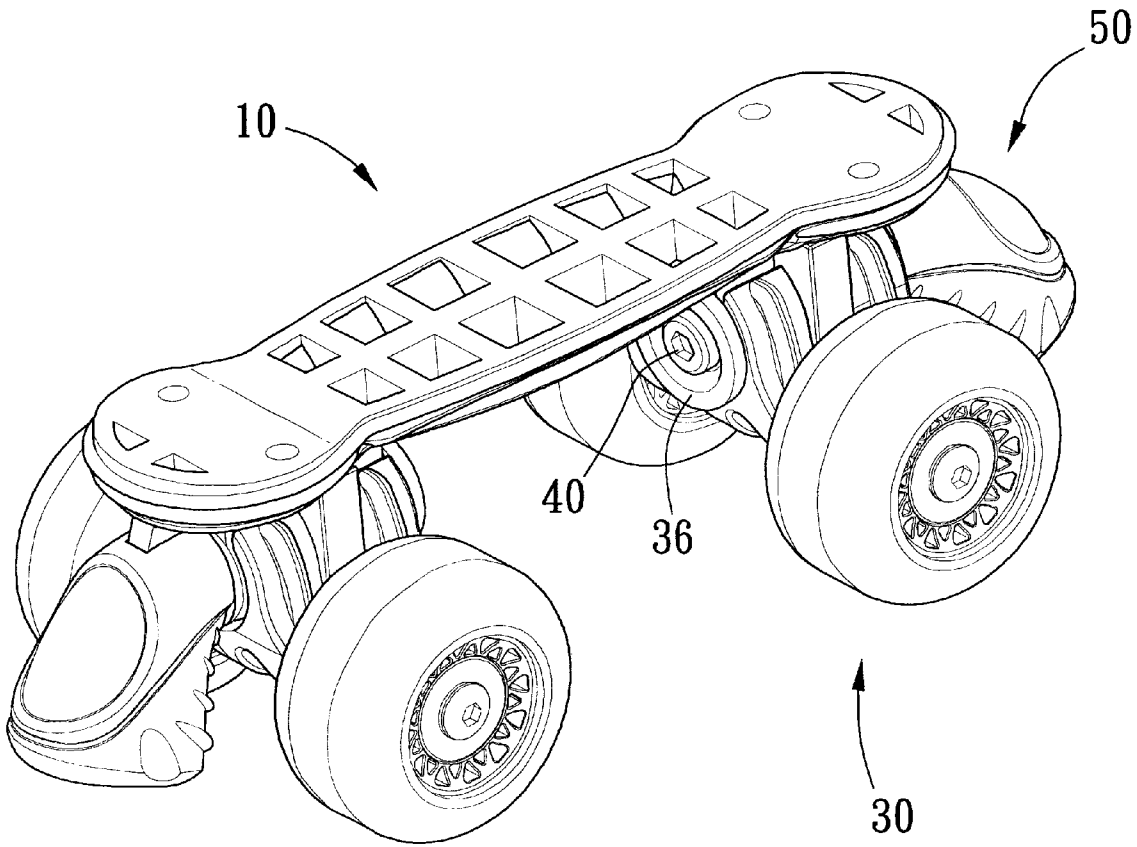
FIG. 2 is a perspective view showing the appearance of an embodiment of the present invention.

Referring to FIG. 2, a preferred embodiment of the present invention is comprised of a sole plate 10, a plurality of vibration absorbing members 20, wheel axle covers 30, bolts 40 and braking blocks 50. Wherein, the sole plate 10 is integrally formed by injection molding of plastic into an elongate sheet, and is provided on the front end thereof with a gradually raised slope 11, and further is provided at the suitable locations on both the front and the rear ends thereof with two parallel down protruding blocks 12, 15 (12', 15') each in the shape of a conical member. The two protruding blocks 12, 15 (12', 15') have therebetween a gap 14 (14'), and are provided centrally each with a through hole 13 (13'). The outer protruding block 12 (15') is provided on the upper portion thereof with a positioning block 16 (16') (also referring to FIG. 3).

The vibration absorbing members 20 are made blocks of the material polyurethane and each has a width to meet the size of the gap 14 (14') between the two protruding blocks 12, 15 (12', 15').

The wheel axle covers 30 have their corresponding axle rods mounted each with either end thereof in a bearing 33, a wheel 31 and another bearing 33 in sequence. A combining portion 32 is provided on the axle rod between every two wheels 31, the combining portion 32 is provided thereon with an opening 34 with a contour and a length mating with those of both the two protruding blocks 12, 15 (12', 15') on the bottom of the sole plate 10. The combining portion 32 is provided further on one end thereof with a sealed connecting portion 37 (37') in coincidence with the shape of the cross section of the opening 34, the sealed connecting portion 37 (37') can prevent the combining portion 32 from dropping off the two protruding blocks 12, 15 (12', 15') of the sole plate 10, and a metallic cap 36 is provided with a recess and a central hole to reinforce the sealed connecting portion 37 (37').

The braking blocks 50 are conical members each with a bending portion, the conical member is provided on the bottom thereof with a plurality of concentric recesses. The top surface of each braking block 50 is embedded therein a nut 51 of which the upper rim portion has a positioning groove 52.

Figure 3:
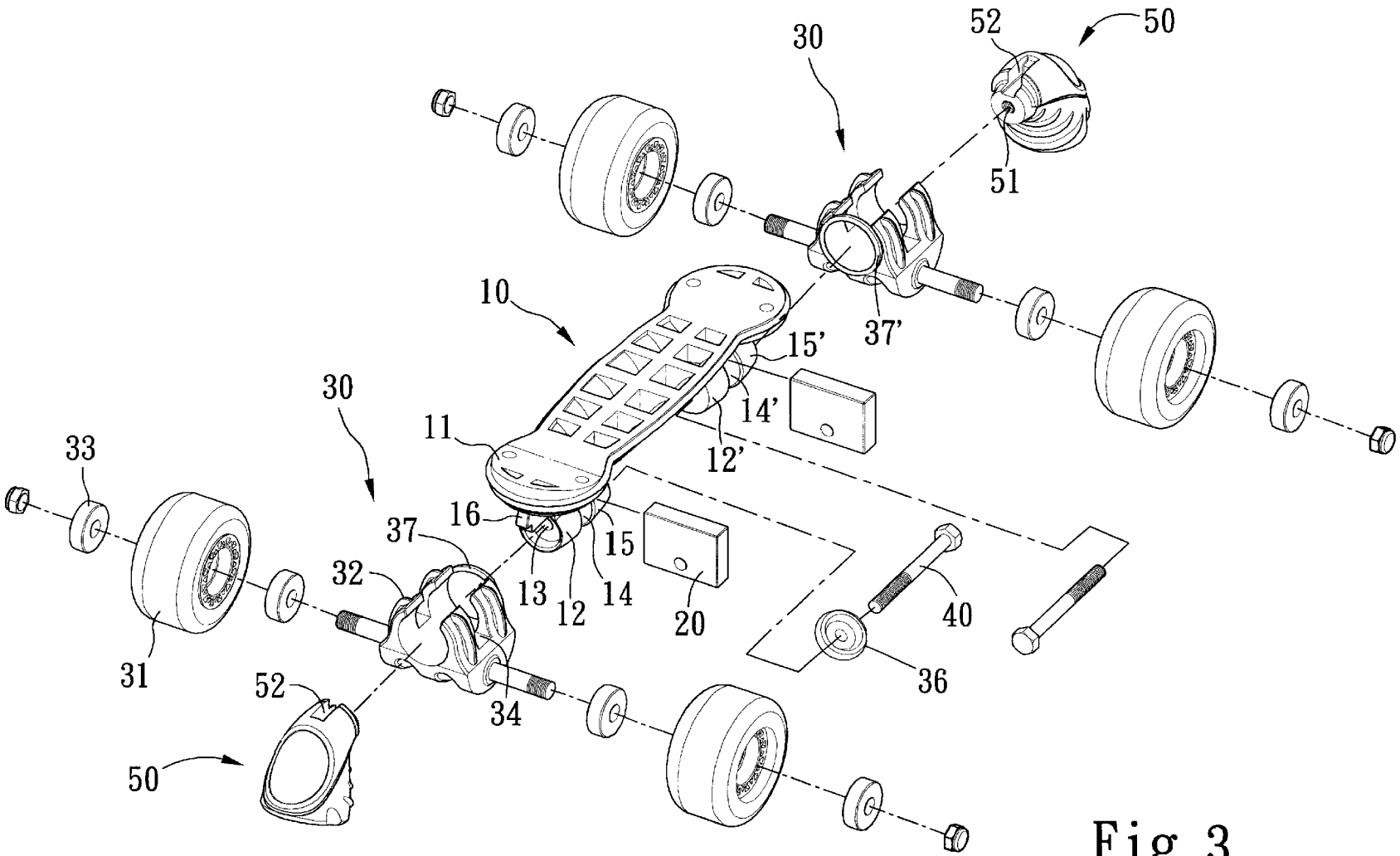
FIG. 3 is an analytical perspective view showing the elements of the embodiment of the present invention.
Figure 4:
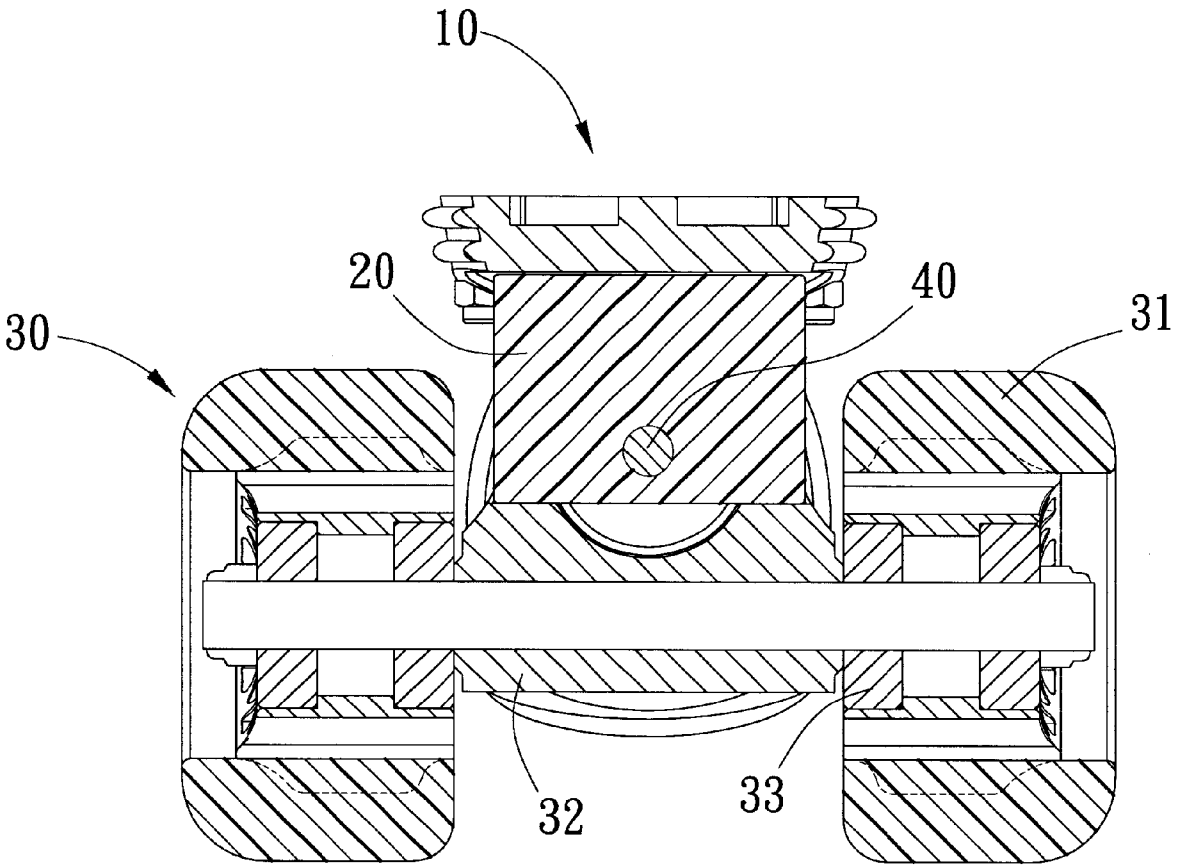
FIG. 4 is a sectional view of the embodiment of the present invention.

Referring simultaneously to FIGS. 3 and 4, the vibration absorbing members 20 (polyurethane) same in width are placed in the gaps 14, 14' between the front and the rear protruding blocks 12, 15, 12', 15', and then the combining portions 32 of the wheel axle covers 30 are taken to envelop the vibration absorbing members 20 and the protruding blocks 12, 15, 12', 15', the metallic caps 36 cover the sealed connecting portion 37, 37' on the rears of the combining portions 32. And then the bolts 40 are extended through the metallic caps 36 and the holes 13, 13' provided in the protruding blocks 12', 15, and further extended directly through the vibration absorbing members 20 (polyurethane) and out of the other protruding blocks 12, 15'. The positioning grooves 52 of the braking blocks 50 are fitted over the positioning blocks 16, 16' respectively, and the bolts 40 are directly screw connected with the nuts 51 of the braking blocks 50 to combine the wheel axle covers 30, the vibration absorbing members 20 (polyurethane), the sole plate 10 and the braking blocks 50 into a unit. Thereby, assembling of the roller skate with braking blocks 50 both on the front and the rear ends thereof is completed. Further, the metallic caps 36 can reinforce the combining of the sole plate 10 with the wheel axle covers 30.

Figure 5:
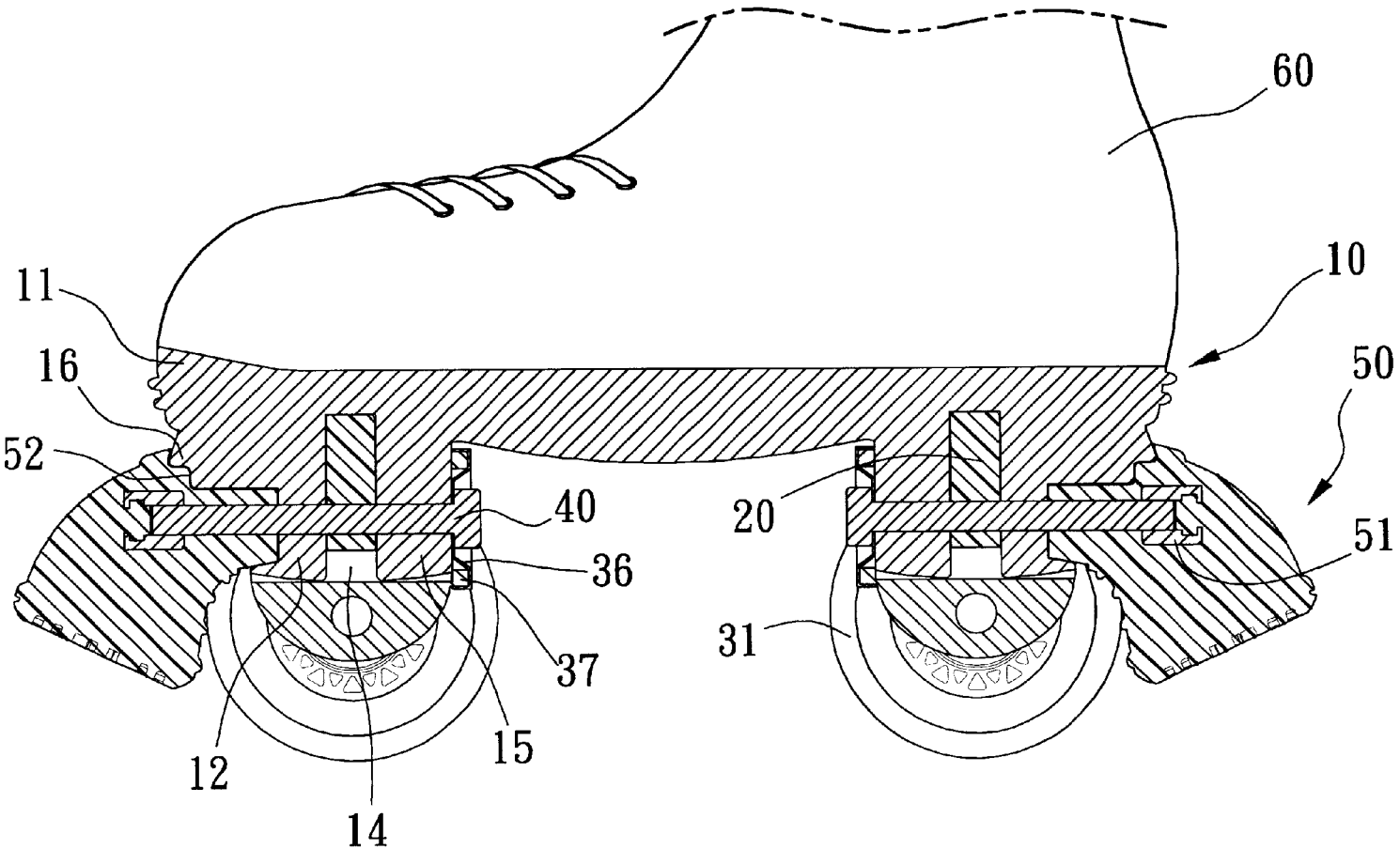
FIG. 5 is a sectional schematic view showing use of the embodiment of the present invention.
Figure 6:
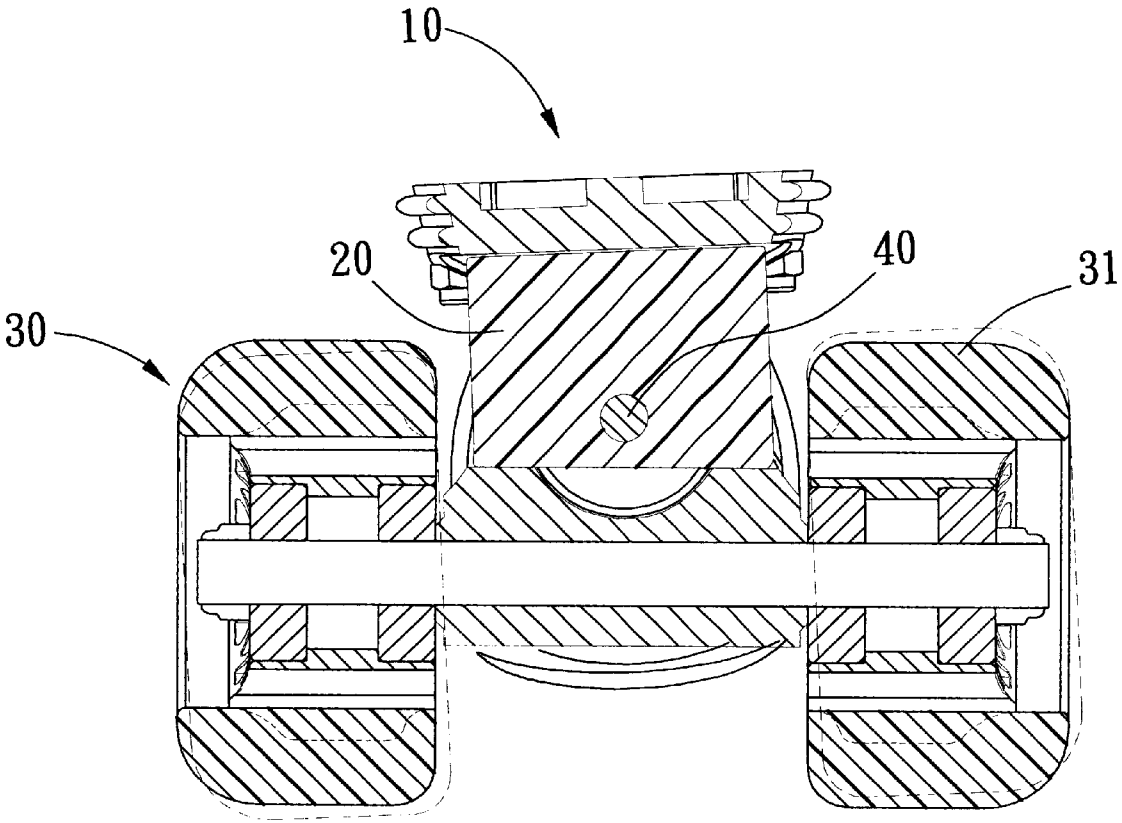
FIG. 6 is a sectional schematic view also showing use of the embodiment of the present invention.

The tip portion of a common sports shoe 60 is made slightly bending up in pursuance of the human engineering, when it contacts with a conventional roller skate, the tip portion can not be tightly contacted, and the conventional roller skate is apparently not as fine as an in-line skate. As shown in FIG. 5, the sole plate 10 of the present invention is provided on the front end thereof with a slightly bending up slope 11, hence when the sole plate 10 is contacted with the shoe body 60, the gap between the sole plate 10 and the shoe body 60 can be effectively eliminated, and the appearance of the roller skate during contacting can be better. When in turning during skating, the gravity of the shoe body 60 will change in pursuance of the action of skating to deviate leftwards or rightwards from time to time, and vibration induced at the side bearing more load (small vibration induced during deviating leftwards or rightwards) will be absorbed by the vibration absorbing members 20. As is shown in FIG. 6, the wheel axle covers 30 is connected with the sole plate 10 by means of the bolts 40 parallel to the sole plate 10, therefore, vibration induced by deviating leftwards or rightwards will be absorbed by the vibration absorbing members 20 (polyurethane) in turning and circling during skating. And the braking blocks 50 are provided both on the front and the rear ends of the roller skate, thereby the roller skate can have braking effect either on the front and the rear ends.

In conclusion, according to the above statement, the present invention can surely get its expected objects, and provides the structure of the sole plate of the roller skate rendering the vibrations induced in tilting to be completely absorbed, thereby it is practically valuable.

The above stated is only for illustrating a preferred embodiment of the present invention, and not for giving any limitation to the scope of the present invention. Various modifications or changes can be made to the elements of the present invention without departing from the spirit and principle of this invention. Accordingly, all such modifications and changes also fall within the scope of the appended claims and are intended to form part of this invention.

What is claimed is:

1. A sole plate structure of a roller skate, wherein a sole plate is integrally formed by injection molding of plastic into a flat and elongate shape, and is provided on both the front and the rear ends thereof with a pair of down protruding blocks with a gap left therebetween; said protruding blocks are provided each with a through hole, and every said pair of protruding blocks are placed therebetween a vibration absorbing member, two wheel axle covers are provided for front and rear wheels on said roller skate to respectively envelop one of said vibration absorbing members and a corresponding pair of said protruding blocks together, a bolt extends through and connects said one of said vibration absorbing members and said corresponding pair of said protruding blocks, said vibration absorbing member effectively absorb vibrations induced in tilting sidewards of said roller skate; said sole plate structure including a pair of axle rods disposed in said wheel axle covers and wherein, each of said wheel axle covers includes a combining portion provided thereon with an opening with a contour and a length mating with said corresponding pair of said protruding blocks on the bottom of said sole plate; said opening is narrower on the upper portion and is wider on the lower portion thereof.

2. A sole plate structure of a roller skate as in claim 1, wherein, said combining portions each is integrally formed on one end thereof a sealed connecting portion in coincidence with the shape of the cross section of said opening.

3. A sole plate structure of a roller skate as in claim 2, wherein, said combining portions each is provided with an axle hole in concentricity with said through holes of said corresponding pair of said protruding blocks.

4. A sole plate structure of a roller skate as in claim 3, wherein, a metallic cap provided with a recess and a central hole is provided on said combining portion of each of said wheel axle covers and is locked with one of said bolts.

5. A sole plate structure of a roller skate as in claim 1, wherein, said bolts are used to firmly lock braking blocks, said braking blocks are conical members each with a bending portion, each of said conical members is provided on the bottom thereof with a plurality of concentric recesses; the top surface of each of said braking blocks respectively on the front and the rear ends of said roller skate is embedded therein a nut.

* * * * *